US006077119A

United States Patent [19]

Yu et al.

[11] Patent Number: 6,077,119

[45] Date of Patent: Jun. 20, 2000

[54] SHIELDING DEVICE FOR A CONNECTOR UNIT AND THE CONNECTOR UNIT USING THE SAME

[75] Inventors: Hung-Chi Yu, Taipei Hsien; Yu-Ming Ho, Pen Chiao, both of Taiwan

[73] Assignee: Hon Hai Precision Ind. Co., Ltd., Taipei Hsien, Taiwan

[21] Appl. No.: 09/104,884

[22] Filed: Jun. 25, 1998

[30] Foreign Application Priority Data

Jun. 25, 1997 [TW] Taiwan ..... 86210606

[51] Int. Cl.[7] ..... H01R 13/648

[52] U.S. Cl. ..... 439/607

[58] Field of Search ..... 439/607, 541.5, 439/64

[56] References Cited

U.S. PATENT DOCUMENTS

| | | | |
|---|---|---|---|
| 5,547,397 | 8/1996 | Hirai | 439/607 |
| 5,643,001 | 7/1997 | Kaufman | 439/541.5 |
| 5,795,190 | 8/1998 | Ono | 439/607 |
| 5,967,845 | 10/1999 | Ho | 439/607 |

*Primary Examiner*—Lincoln Donovan
*Assistant Examiner*—Javaid Nasri

[57] ABSTRACT

A shielding device for covering a card bus connector includes a first metal plate including an engaging binding for engaging with a front face of the card bus connector, and a second metal plate including a clip formed by two tabs on opposite sides of the second metal plate for engaging with two sides of the card bus connector. The first metal plate and the second metal plate fully cover a top surface and a bottom surface of the card bus connector, respectively.

9 Claims, 3 Drawing Sheets

SHIELDING DEVICE FOR A CONNECTOR UNIT AND THE CONNECTOR UNIT USING THE SAME

BACKGROUND OF THE INVENTION

1. Field of the Invention

The present invention relates to a shielding device for a connector unit, such as a card bus connector, and the connector unit using the same, and particularly to a shielding device which provides the related connector unit with satisfactory effects of noise suppressing, stable transmission, and particle isolation.

2. The Prior Art

Noise inevitably exists during signal transmission between electrical devices connected by wires and connectors. The noise may result from electrostatic discharge (ESD) or electromagnetic interference (EMI). ESD exists on two device surfaces when sufficient particles settle thereon thus forming an electrostatic capacitor between the two devices which emits electrostatic electrons that interfere with the performance of the related devices and other peripherals. When two mating devices, such as an electrical card and a related card connector are abruptly connected together in a relatively dry environment, particles on the devices may cause an electrostatic discharge and damage the components within the electrical card. Noise can also result from EMI which is related to an electrical current flowing through the devices. Prior art which prevent noise from affecting the card connector include U.S. Pat. Nos. 5,288,247, 5,470,259 and 5,478,260. However, these disclosures only provide a front shielding to cover a front edge of the connector where soldering portions of the contacts are to be soldered on a printed circuit board. No shielding is provided to cover the guiding frame of the connector, thus the noise problem still exists due to insufficient shielding protection of the card connector. If an electrical card and a reception interface of the card connector are not sufficiently isolated or protected by a metal shield, these portions will be adversely affected by EMI. Additionally, dust is apt to gather on the card-connector assembly due to an insufficient metal shield thus causing ESD. Moreover, heat dissipation is a problem encountered in the PC field for meeting the high power and high frequency trend of signal transmission.

Therefore, an improved shielding device for a card connector is required to eliminate the above mentioned drawbacks of the prior art especially one which can considerably eliminate problems resulting from ESD and EMI.

SUMMARY OF THE INVENTION

The primary purpose of the present invention is to provide a shielding device for protecting the related card connector from ESD and EMI problems.

A second purpose of the present invention is to provide a shielding device which is easily assembled to the card connector and provides heat sink effects for the entire connector.

In accordance with one aspect of the present invention, a shielding device for covering a card bus connector includes a first metal plate including an engaging binding for engaging with a front face of the card bus connector, and a second metal plate including a clip formed by two tabs on opposite sides of the second metal plate for engaging with two sides of the card bus connector. The first metal plate and the second metal plate fully cover a top surface and a bottom surface of the card bus connector, respectively.

In accordance with another aspect of the present invention, a card bus connector comprises at least two stacked housings within which a plurality of contacts are retained. A guiding frame is connected to the at least two stacked housings and comprises a pair of guiding bars forming two sides of the card bus connector. Each guiding bar defines the same number of channels and at least a recess in one end thereof.

In accordance with a further aspect of the present invention, a card bus connector comprises at least two stacked housings within which a plurality of contacts are retained. A guiding frame is connected to the at least two stacked housings and comprises a pair of guiding bars forming two sides of the card bus connector. Each guiding bar defines the same number of channels and at least a recess in one end thereof. An ejector mechanism is connected to the at least two stacked housings and the guiding frame for ejecting electrical cards received in the at least two stacked housings. A shielding device comprises a first metal plate and a second metal plate. The first metal plate include an engaging binding for engaging with the recess defined in the guiding bar. The second metal plate includes a clip formed by two tabs on opposite sides of the second metal plate for engaging with two sides of the card bus connector. The first metal plate and the second metal plate fully cover a top surface and a bottom surface of the card bus connector, respectively.

DETAILED DESCRIPTION OF THE PREFERRED EMBODIMENTS

Figure 1:
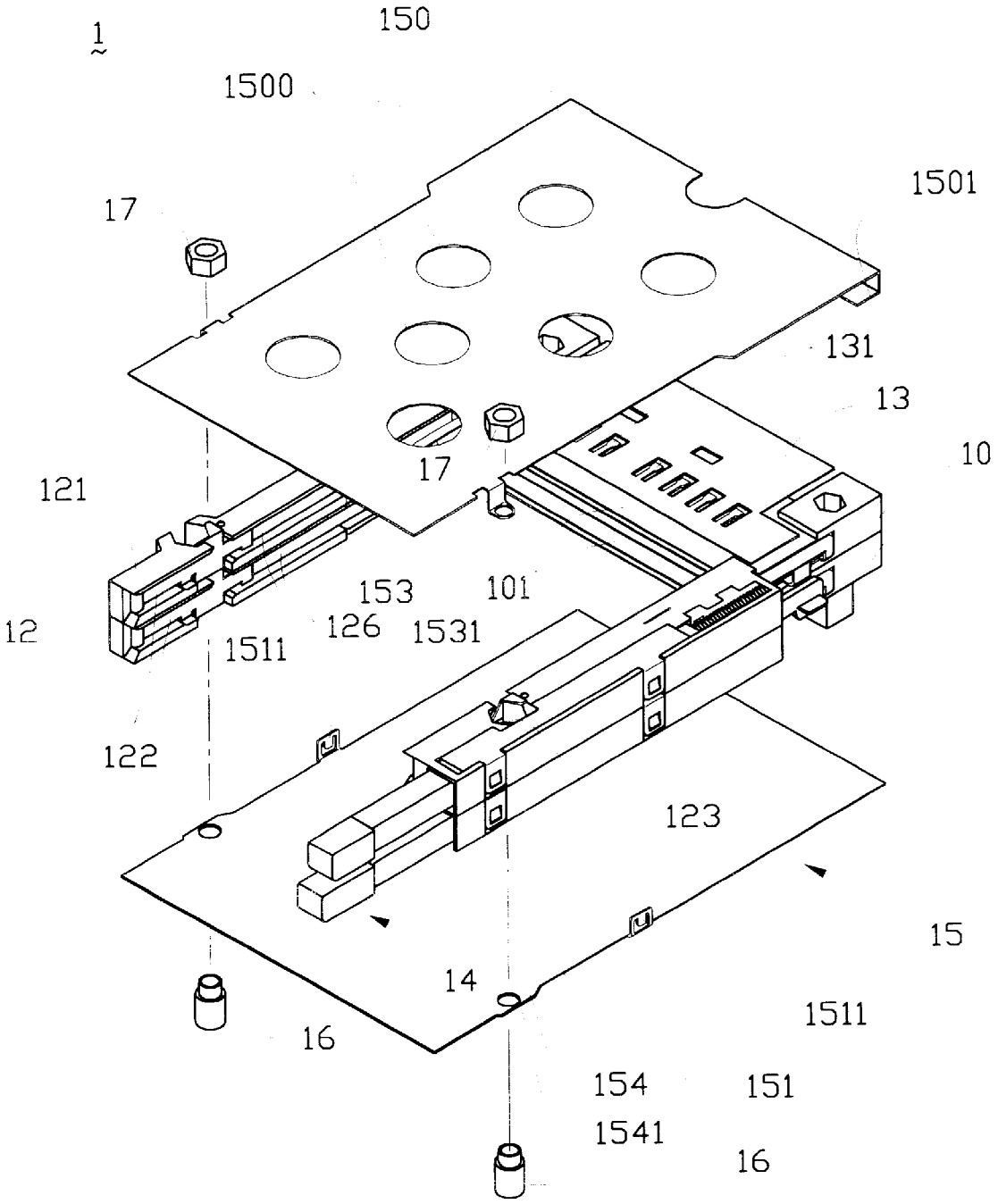
FIG. 1 is an exploded view of a stacked connector unit and a shielding device to be attached thereto in accordance with the present invention.
Figure 2:
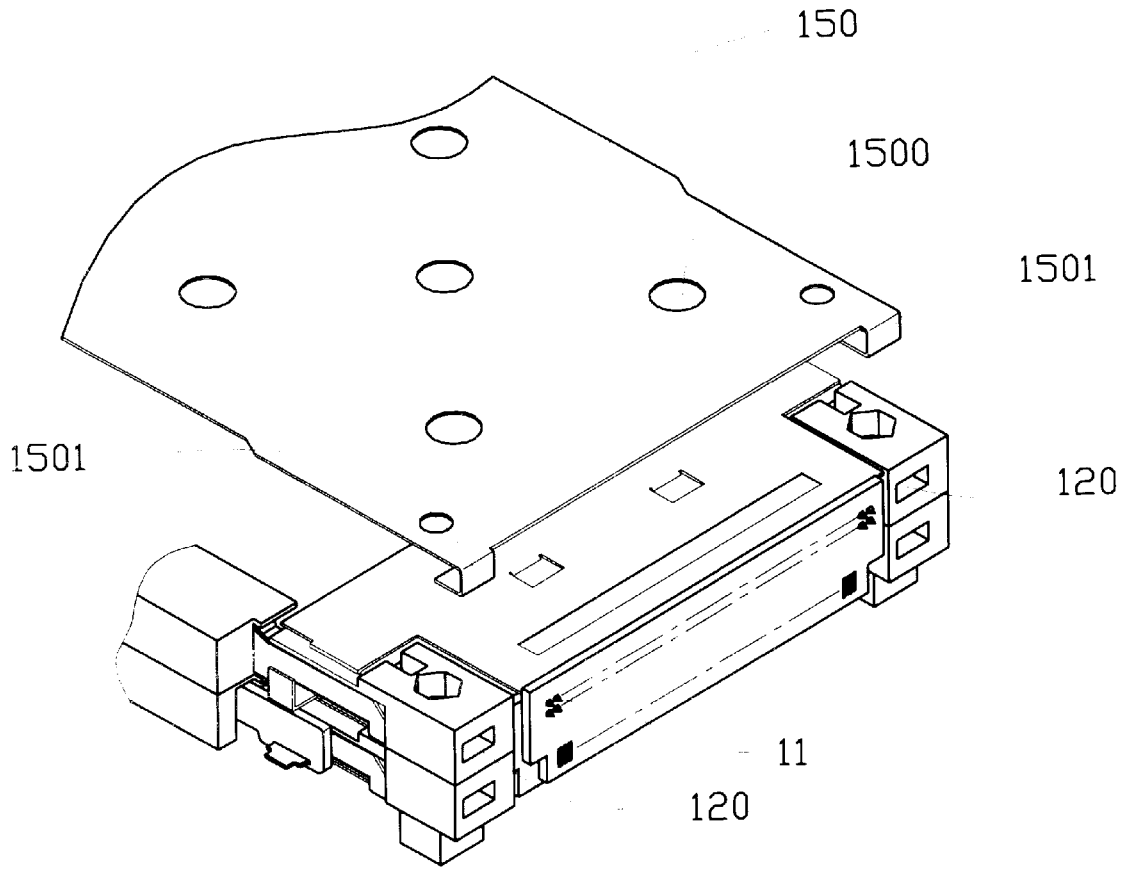
FIG. 2 is a top front view of a portion of FIG. 1 showing how a top shielding member is assembled to the stacked connector unit.
Figure 3:
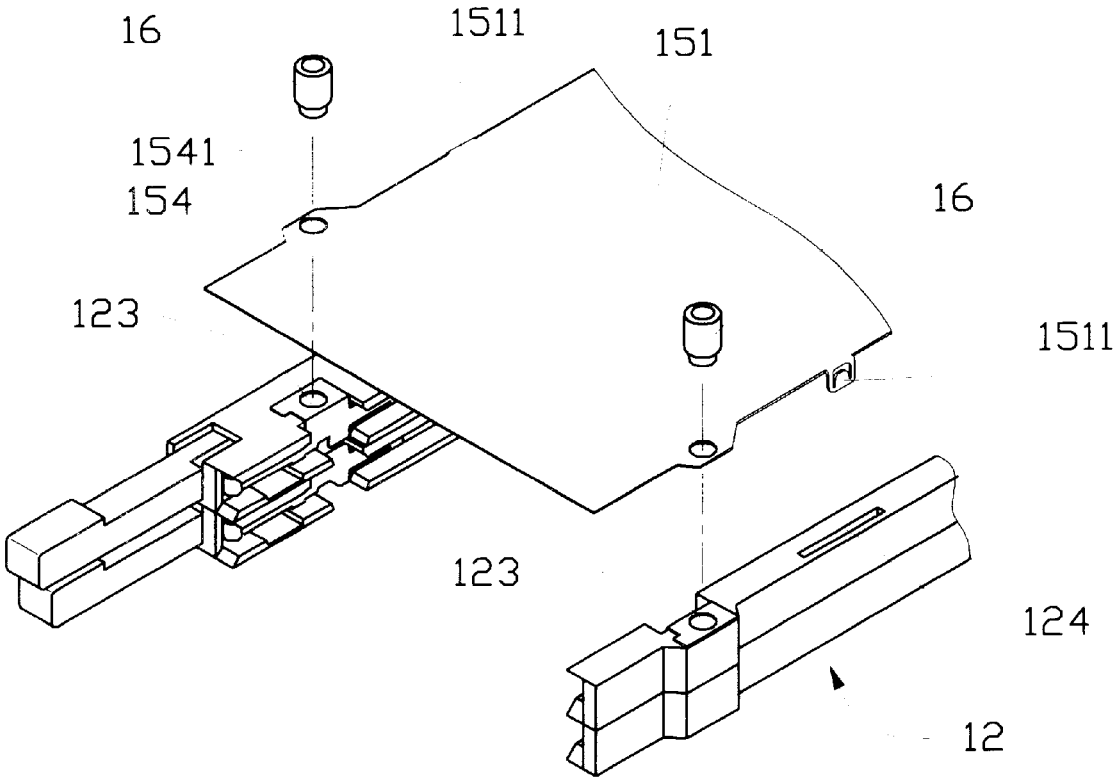
FIG. 3 is a bottom rear view of a portion of FIG. 1 showing how a bottom shielding member is assembled to the stacked connector unit.

Referring to FIGS. 1, 2, and 3, a stacked connector unit 1 (card bus connector) in accordance with the present invention comprises two stacked housings 10 which includes card receptacles 101 for receiving electrical cards (not shown). A plurality of contacts 11 are retained in the card receptacles 101 for electrical engagement with the inserted cards, and free ends of the contacts 11 extend outward from a front side of the housings 10.

A guiding frame 12 comprises two parallel guiding bars 121 connected to each lateral end of the card receptacles 101. A recess 120 is formed in the end of each guiding bar 121 and a slot 124 is defined in a bottom surface of the guiding frame 12. Each guiding bar 121 defines upper and lower channels 126 with metal grounding plates 122 attached to an inner surface of each channel 126. Each guiding bar 121 also defines a vertical hole 123 for engagement purposes which will be described later. An ejector mechanism 14 for ejecting inserted cards has a portion slidably received in the channels 126 of the guiding frame 12. The details of the ejector mechanism 14 are disclosed in pending U.S. patent application Ser. No. 08/956,347 which has been assigned to the same assignee of this application. A metal plate 13 fixed on top of the card receptacle 101, defines a plurality of grounding tabs 131 for grounding purposes.

A shielding device 15 includes an upper metal plate 150 and a lower metal plate 151 respectively covering top and bottom surfaces of the stacked connector unit 1.

The upper metal plate 150 defines a plurality of holes 1500 for facilitating heat dissipation of an inserted card. Two engaging bindings 1501 are formed on one side of the upper metal plate 150 for engagement with the recesses 120 of the guiding frame 12 thereby fixing the upper plate 150 on the top surface of the stacked connector unit 1. The upper metal plate 150 also includes a pair of locking tabs 153 respectively formed at opposite sides thereof and each defining a hole 1531 therein.

The lower metal plate 151 respectively forms two tabs 1511 at opposite sides thereof, functioning as a clip for engaging with the corresponding slot 124 of the guiding frame 12. The lower metal plate 151 further forms a locking tab 154 at each side thereof substantially aligned with the locking tabs 153 of the upper metal plate 151. Each locking tab 154 of the lower metal plate 151 defines a hole 1541 therein. The locking tabs 153 of the upper metal plate 151 are received in the corresponding vertical holes 123 of the guiding bars 121, and the holes 1531 of the locking tab 151 of the upper metal plate 150 are aligned with the holes 1541 of the locking tabs 154 of the lower metal plate 151 when the upper metal plate 150 and the lower metal plate 151 are respectively secured to the top and bottom surfaces of the connector unit 1. A pair of standoff sleeves 16 and corresponding nuts 17 cooperating with the screws (not shown) are used not only to secure the upper and lower metal plates 150, 151 together thereby fixing the metal plates 150, 151 to the connector unit 1, but also to ground them to the corresponding circuits on the PC board (not shown) on which the card bus connector is mounted.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A shielding device for covering a card bus connector, the shielding device comprising:

a first metal plate including an engaging binding for engaging with a front face of the card bus connector and defining a plurality of heat sink holes for facilitating the dissipation of heat of an inserted card, the engaging binding being an L-shaped binding which is firstly bent downward from the first metal plate and further bent perpendicular to the downward portion; and a second metal plate including a clip formed by two tabs on opposite sides of the second metal plate for engaging with opposite sides of the card bus connector;

wherein the first metal plate and the second metal plate fully cover a top surface and a bottom surface of the card bus connector, respectively.

2. The shielding device as claimed in claim 1, wherein the first metal plate forms a pair of first locking tabs each defining a first locking hole therein, the second metal plate forms a pair of second locking tabs each defining a second locking hole therein and aligned with the first locking holes, and a pair of bolts and corresponding nuts are used to secure the two locking tabs together thereby securing the first and the second metal plates together.

3. A card bus connector comprising:

at least two stacked housings within which a plurality of contacts are retained;

a guiding frame connected to the at least two stacked housings and comprising a pair of guiding bars forming two sides of the card bus connector and at least a recess in one end thereof, each of the guiding bars defining at least an upper and a lower channels;

an ejector mechanism connected to the at least two stacked housings and the guiding frame for ejecting electrical cards received in the at least two stacked housings; and a shielding device comprising a first metal plate and a second metal plate, the first metal plate including an engaging binding for engaging with the recess defined in the guiding bar and defining a plurality of heat sink holes for facilitating the dissipation of heat of an inserted card, and the second metal plate including a clip formed by two tabs on opposite sides of the second metal plate for engaging with two sides of the card bus connector;

wherein the first metal plate and the second metal plate fully cover a top surface and a bottom surface of the card bus connector, respectively.

4. The card bus connector as claimed in claim 3 wherein the engaging binding is an L-shaped binding which is firstly bent downward from the first metal plate and further bent perpendicular to the downward portion.

5. The card bus connector as claimed in claim 3 wherein the first metal plate of the shielding device forms a pair of first locking tabs each defining a first locking hole therein, the second metal plate of the shielding device forms a pair of second locking tabs each defining a second locking hole therein and aligned with the first locking holes, and a pair of bolts and corresponding nuts are used to secure the two locking tabs together thereby securing the first and the second metal plates together.

6. The card bus connector as claimed in claim 5, wherein each of the guiding bars defines a vertical hole for receiving the first locking tab of the first metal plate, the nut, and a portion of the bolt.

7. A card bus connector comprising:

a pair of stacked housings each including a card receptacle retaining a plurality of contacts therein;

a guiding frame connected to said card receptacles, said guiding frame including two parallel bars respectively connected to both ends of the receptacles, each of said bars defining an upper channel and a lower channel; and a first metal plate and a second metal plate respectively fully covering a top surface and a bottom surface of the card bus connector the first metal plate defining a plurality of heat sink holes for facilitating the dissipation of heat of an inserted card; wherein at least a standoff sleeve cooperating with at least a nut not only fastening the first and the second metal plates to the connector, but also grounding the first and the second metal plates to grounding circuits on a PC board on which the connector is mounted.

8. The connector as claimed in claim 7, wherein the first metal plate and the second metal plate respectively include the fastening holes aligned with each other and with the corresponding nut and sleeve.

9. A shielding device for covering a card bus connector, the shielding device comprising:

a first metal plate including an engaging binding for engaging with a front face of the card bus connector and defining a plurality of heat sink holes for facilitating the dissipation of heat of an inserted card; and a second metal plate including a clip formed by two tabs on opposite sides of the second metal plate for engaging with opposite sides of the card bus connector;

wherein the first metal plate and the second metal plate fully cover a top surface and a bottom surface of the card bus connector, respectively; and wherein the first metal plate forms a pair of first locking tabs each defining a first locking hole therein, the second metal plate forms a pair of second locking tabs each defining therein a second locking hole aligned with the corresponding first locking hole, and a pair of bolts and corresponding nuts are used to secure the two locking tabs together thereby securing the first and the second metal plates together.

* * * * *